United States Patent [19]

Ogawa

[11] 4,454,842

[45] Jun. 19, 1984

[54] INTERNAL COMBUSTION ENGINE WITH BEARING BEAM STRUCTURE

[75] Inventor: Naoki Ogawa, Yokosuka, Japan

[73] Assignee: Nissan Motor Company, Ltd., Yokohama, Japan

[21] Appl. No.: 367,926

[22] Filed: Apr. 13, 1982

[30] Foreign Application Priority Data

May 20, 1981 [JP] Japan ..... 56-71881[U]

[51] Int. Cl.[3] ..... F02B 19/00

[52] U.S. Cl. ..... 123/195 R; 123/195 H; 123/195 C; 384/429

[58] Field of Search ..... 123/195 R, 195 C, 195 H; 384/429, 432, 433; 308/179

[56] References Cited

U.S. PATENT DOCUMENTS 4,213,440 7/1980 Abe et al. ..... 123/195 R
4,230,087 10/1980 Abe et al. ..... 123/198 E

FOREIGN PATENT DOCUMENTS 0923580 2/1955 Fed. Rep. of Germany ..... 384/429
472638 4/1947 France .
1422703 1/1976 United Kingdom .
1481139 7/1977 United Kingdom .
2008195 5/1979 United Kingdom .

OTHER PUBLICATIONS

AUTOMOBILTECHNISCHE ZEITSCHRIFT, vol. 80, No. 5, May 1978, Stuttgart H. DROSCHA "Preisgekronte Kurbelgehause-Konstruktion", p. 228.

*Primary Examiner*—Craig R. Feinberg
*Assistant Examiner*—David A. Okonsky
*Attorney, Agent, or Firm*—Schwartz, Jeffery, Schwaab, Mack, Blumenthal & Koch

[57] ABSTRACT

An internal combustion engine comprises a cylinder block having cylinder barrels and bearing sections, and a bearing beam structure including bearing cap sections each of which associates with each cylinder block bearing section so as to rotatably support the journal of a crankshaft, first and second upper beam sections disposed along the two upper opposite portions of each bearing cap section to securely connect the bearing cap sections with each other, and first and second lower beam sections disposed along the two lower opposite portions of each bearing cap section to securely connect the bearing cap sections with each other, thereby effectively reducing engine noise particularly due to the vibration of a skirt section of the cylinder block.

6 Claims, 8 Drawing Figures

INTERNAL COMBUSTION ENGINE WITH BEARING BEAM STRUCTURE

BACKGROUND OF THE INVENTION

1. Field of the Invention

This invention relates to a low-noise level automotive internal combustion engine, and more particularly to such an engine equipped with a bearing beam structure for supporting a crankshaft in a manner to reduce engine noise level.

2. Description of the Prior Art

As a cause of engine noise, vibration noise is emitted from the cylinder block skirt or lower section and from the oil pan which noise is caused by the vibration of a cylinder block. In order to reduce such vibration noise it would seem sufficient to suppress vibration, due to explosion torque applied to the crankshaft by increasing the rigidity of the cylinder block. However, this unavoidably leads to an increase in cylinder block wall thickness and accordingly to a great increase in engine weight, thereby giving rise to new problems such as reduced fuel economy. In view of this, a variety of propositions have been made to improve the rigidity of the cylinder block while suppressing the increase in cylinder block weight. Of these propositions, attention has been paid to the employment of a bearing beam structure which securely connects a plurality of bearing caps directly supporting the crankshaft to improve the strength of the bearing caps and engine parts associated with them.

BRIEF SUMMARY OF THE INVENTION

In accordance with the present invention, an internal combustion engine comprises a cylinder block having a plurality of cylinder barrels, and a plurality of bearing sections for the journals of a crankshaft. A bearing beam structure is secured to the bottom part of the cylinder block and includes a plurality of bearing cap sections each of which associates with each cylinder block bearing section to define a bore for rotatably receiving the crankshaft journal. First and second upper beam sections are disposed parallel with the axis of the crankshaft and located respectively along the two upper portions, opposite to each other with respect to the crankshaft axis, of each bearing cap section to securely connect the bearing cap sections. The first and second upper beam sections are located in the vicinity of the cylinder block bottom part. Additionally, first and second lower beam sections are disposed parallel with the crankshaft axis and located respectively along the two lower portions, opposite to each other with respect to the crankshaft axis, of each bearing cap section. The first and second lower beam sections are positioned apart from the first and second upper beam sections.

With the thus arranged engine, the skirt section of the cylinder block is prevented from vibrating, and the whole cylinder block is improved in flexural and torsional rigidities, thereby effectively reducing engine noise within a frequency range which is critical and predominant for automotive internal combustion engines.

BRIEF DESCRIPTION OF THE DRAWINGS

The features and advantages of the internal combustion engine according to the present invention will be more appreciated from the following description in conjunction with the accompanying drawings in which like reference numerals designate like parts and elements, in which.

DETAILED DESCRIPTION OF THE INVENTION

Figure 1:
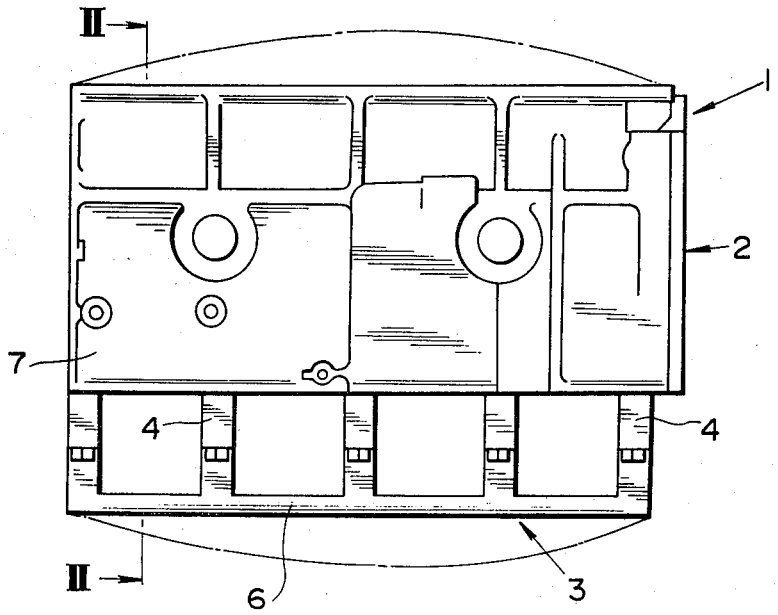
FIG.1 PRIOR ART
FIG. 1 is a front elevation of a conventional internal combustion engine.
Figure 2:
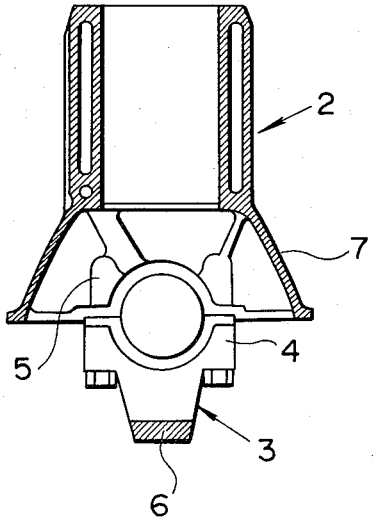
FIG.2 PRIOR ART
FIG. 2 is a vertical sectional view taken in the direction of arrows substantially along the line II—II of FIG. 1.
Figure 3:
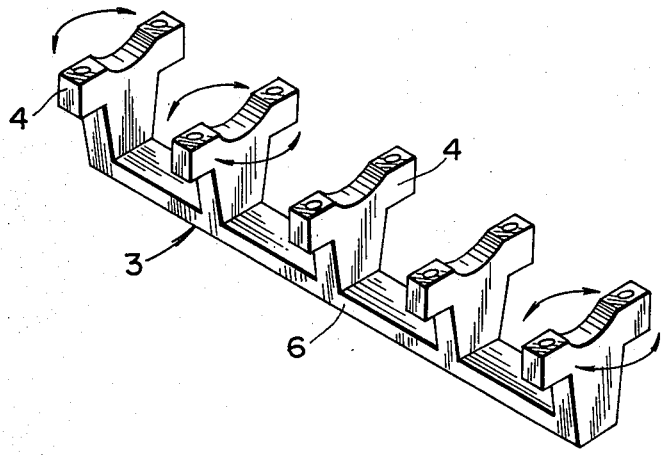
FIG.3 PRIOR ART
FIG. 3 is a perspective view of a bearing beam structure used in the engine of FIG. 1.

To facilitate understanding the invention, a brief reference will be made to an engine block 1 of a conventional automotive internal combustion engine, depicted in FIGS. 1 to 3. Referring to FIGS. 1, 2 and 3, the engine block 1 includes a cylinder block 2, and a bearing beam structure 3 secured to the bottom part of the cylinder block 2 by means of bolts. The bearing beam structure 3 has a plurality of main bearing cap sections 4 which respectively with bearing sections 5 or main bearing bulkheads of the cylinder block 2, as shown in FIG. 3. The thus associated bearing cap sections 4 and cylinder block bearing section 5 rotatably support the journal of a crankshaft (not shown). The bearing cap sections 4 are securely or integrally connected with each other through a beam section 6 extending along the axis of the crankshaft, so that the rigidity of the engine block 1 can be increased. Therefore, the engine block 1 may be improved in flexural rigidity against the flexural vibration indicated in phantom in FIG. 1 and against the vibration of the bearing cap sections 4 in the axial direction of the crankshaft or the fore-and-aft direction which vibration so acts on each bearing cap section to cause it to come down.

However, with the above-mentioned arrangement, although the flexural rigidity of the engine block 1 is increased against the deflection relative to the axis parallel with the crankshaft axis, a desired low level of engine noise cannot be attained because of the fact that the bearing beam structure 3 merely contributes to a slight rise in the resonance frequency of the cylinder block in the vicinity of 1800 Hz, the vibration due to such frequency being, in fact, not so critical for the total engine noise. In this connection, experimental data of usual automotive engines show that vibration frequencies ranging from 150 to 1500 Hz are critical for the vibration noise emitted from the engine block 1.

Furthermore, even if each main bearing cap section 4 is prevented from vibration in the fore-and-aft direction causing it to come down, it is not effective for suppressing the vibration of a cylinder block skirt section 7, bulged outwardly to define thereinside the upper section of a crankcase (not identified), in the lateral direction or open-and-close movement direction. The vibration of the cylinder block skirt section 7 is mainly caused by the vibration of each bearing cap section 4 in the direction indicated by arrows in FIG. 3. Accordingly, the above-mentioned arrangement is not so effective for preventing noise generation from the skirt section 7 and an oil pan (not shown) which is formed of a thin sheet metal and securely attached to the bottom edge of the skirt section 7.

Figure 4:
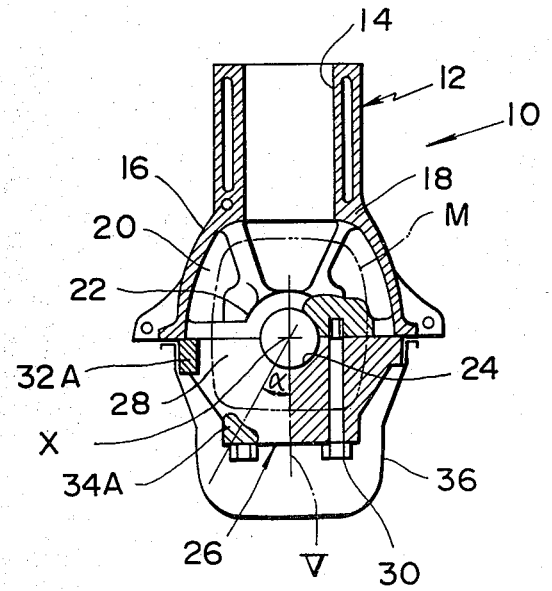
FIG. 4 is a vertical sectional view of a preferred embodiment of an internal combustion engine in accordance with the present invention.
Figure 5A:
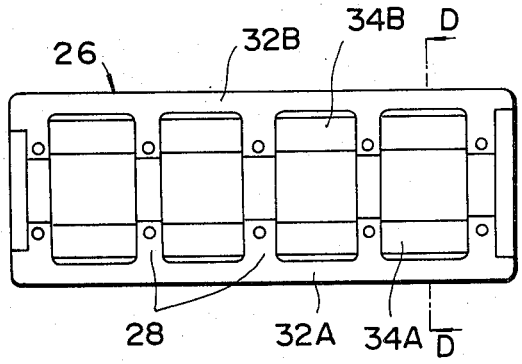
FIG. 5A is a plan view of a bearing beam structure used in the engine of FIG. 4.
Figure 5D:
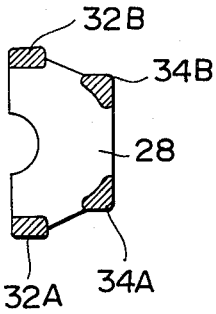
FIG. 5D is a sectional view taken in the direction of arrows substantially along the line D—D of FIG. 5A.
Figure 5B:
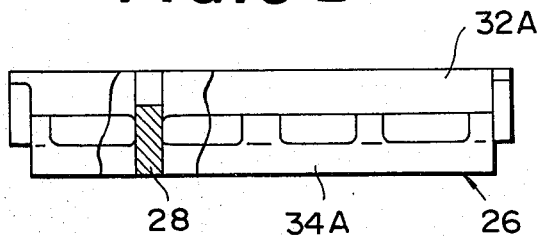
FIG. 5B is a front view of the bearing beam structure of FIG. 5A.
Figure 5C:
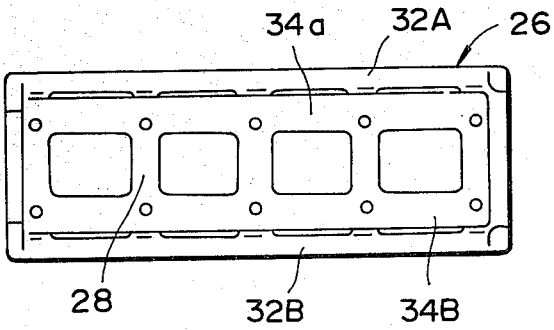
FIG. 5C is a bottom view of the bearing beam structure of FIG. 5A.

In view of the above description of the automotive engine provided with the conventional bearing beam structure, reference is now made to FIGS. 4 to 5D, wherein a preferred embodiment of an internal combustion engine of the present invention is illustrated by the reference numeral 10. The engine 10 in this embodiment is for an automotive vehicle and comprises a cylinder block 12 which is formed with a plurality of cylinder barrels 14 each of which defines therein a cylinder bore (no numeral). The cylinder block 12 includes a skirt section 16 which is bulged outwardly and extends downwardly to define thereinside an upper part of a crankcase (no numeral). The skirt section 16 is integrally connected through a lower block deck 18 with the cylinder barrels 14. A plurality of main bearing bulkheads 20 are parallelly aligned and disposed inside of the skirt section 16. Each bearing bulkhead 20 is located below and connected to a position between the adjacent two cylinder barrels 14. The bearing bulkhead 20 is integrally connected at its top part with the lower block deck 18 and at its side parts with the inner wall of the skirt section 16. Each bearing bulkhead 20 is provided at its bottom central portion with a bearing section 22 for rotatably receiving the journal of a crankshaft (no numeral).

A bearing beam structure 26 is securely connected to the bottom part of the cylinder block 12 and includes a plurality of main bearing cap sections 28. Each bearing cap section 28 is secured at its top portion onto each bearing bulkhead 20 by means of cap bolts 30 so as to associate with the bearing section 22 of the bearing bulkhead 20, thereby a cylindrical bore 24 in which the journal of the crankshaft is rotatably supported. In this instance, each bearing cap section 28 is in the shape of an isosceles trapezoid as viewed from the direction of the axis X of the crankshaft so that its top part contacting with the cylinder block bottom part is wider than its bottom part. As best shown, each bearing cap section 28 is formed in its top part with opposite first and second upper corner portions (no numerals) which are located opposite to or symmetrical with each other with respect to an imaginary vertical plane V containing the crankshaft axis X, and is formed at its bottom part with first and second lower corner portions (no numerals) which are located opposite to or symmetrical with each other with respect to the vertical plane V.

First and second upper beam sections or members 32A, 32B are disposed along and located at the first and second upper corner portions of each of the aligned bearing cap sections 28 in such a manner that the first upper corner portions of the aligned bearing cap sections 28 are securely connected with each other by the first upper beam section 32A, while the second upper corner portions of the aligned bearing cap section 28 are securely connected with each other by the second upper beam section 32B. In this instance, the first and second upper beam sections 32A, 32B are in contact with the bottom part of the cylinder block 12.

First and second lower beam sections or members 32A, 32B are disposed along and located at the first and second lower corner portions of each of the aligned bearing cap sections 28 in such a manner that the first lower corner portions of the aligned bearing cap sections are securely connected with each other by the first lower beam section 34A, while the second lower corner portions of the aligned bearing cap sections 28 are securely connected with each other by the second lower beam section 34B.

The first and second upper beam sections 32A, 32B extend along the crankshaft axis X and are disposed parallel with each other and with the crankshaft axis X. Similarly, the first and second lower beam sections 34A, 34B extend along the crankshaft axis X and are disposed parallel with each other and with the crankshaft axis X. It will be understood that the first and second upper beam sections 32A, 32B are located opposite to or symmetrical with each other with respect to the plane V, and similarly the first and second lower beam sections 34A, 34B are located opposite to or symmetrical with each other with respect to the plane V. Accordingly, a plurality of aligned bearing cap sections 28 are securely and integrally connected with each other through or by the above-mentioned four beam sections 32A, 32B, 34A, 34B to form an integral unit or the bearing beam structure 26.

All the beam members 32A, 32B, 34A, 34B are disposed outside of the envelope M of the outer-most loci of the crankshaft and members connected thereto, and so located as to prevent the interference with the inner wall surface of an oil pan 36 securely connected to the bottom flange portion of the cylinder block skirt section 16. It is preferable that the first and second upper beam sections 32A, 32B are formed generally in the shape of a rectangle in section, whereas the first and second lower beam sections 34A, 34B are formed generally in the shape of a right-angled triangle so that the surface, corresponding to the base of the triangle, of each lower beam section faces the crankshaft or the inside of the bearing beam structure 26, while the ridge, corresponding to the right-angle corner of the triangle, of each lower beam section faces the outside of the bearing beam structure 26 or the inner wall surface of the oil pan 36. It is also preferable that each of the first and second lower beam sections 34A, 34B is so positioned that an imaginary line connected between the center axis thereof and the crankshaft axis X intersects the vertical plane V at an angle ranging from 20 to 70 degrees on an imaginary plane or sectional plane to which the crankshaft axis X is perpendicular, as best shown in FIG. 4. The vertical plane V may contain the axis of each cylinder bore defined in each cylinder barrel 14.

With the thus arranged engine 10 provided with the bearing beam structure 26, the aligned bearing cap sections 28 are integrally connected with each other by means of parallelly disposed beam sections 32A, 32B, 34A, 34B. Therefore, each bearing cap 28 is increased in strength against the force causing the bearing cap section 28 to come down, and is noticeably improved in torsional strength around the crankshaft axis X. In addition, each bearing cap section 28 is effectively and remarkedly improved in flexural strength in the rightward-and-leftward direction around the axis of the cylinder bore. Particularly, the first and second upper beam sections 32A, 32B greatly contribute to an improvement in rigidity in its lateral direction and in torsional rigidity of the whole bearing beam structure 26 and the whole cylinder block 12. In other words, the first and second upper beam sections 32A, 32B can greatly increase the geometrical (second) moment of inertia of the bearing beam structure 26 in its lateral direction or rightward-and-leftward direction. This geometrical moment of inertia can be further effectively increased by employing the above-mentioned arrangement where the line connecting the center axis of each lower beam section 34A, 34B and the crankshaft axis X intersects the vertical plane V at the angle ranging from 20 to 70 degrees on the vertical plane to which the crankshaft axis X is perpendicular.

As a result, the torsional and flexural vibrations of the bearing bulkheads 20 securely connected to the bearing cap section 28 can be largely suppressed, thereby effectively preventing the lateral movement vibration (membrane vibration) or open-and-close movement vibration of the cylinder block skirt section 16 which is connected to the bearing bulkheads 20 at the linear portions which serve as the nodes of the above-mentioned skirt section movement. This can noticeably reduce noise emission due to the vibration of the cylinder block skirt section 16 and the oil pan 36.

As appreciated from the above, according to the present invention, a plurality of the bearing cap sections are tightly connected with each other by means of two upper beam sections located along the upper opposite corner portions of each bearing cap section and by means of two lower beam sections located along the lower opposite corner portions of the same. Accordingly, each bearing cap section and each cylinder block bearing section (bearing bulkheads) are effectively improved in rigidity against the torsional vibration and flexural vibration in its lateral direction. Therefore, the above-mentioned cylinder block skirt section linear portions corresponding to the nodes of vibration can be certainly kept at a stationary state, thereby effectively suppressing the open-and-close movement vibration of the cylinder block skirt section. This can greatly reduce the noise within a frequency range which is most critical for automotive engines, and increase the torsional rigidity of the whole cylinder block and the flexural rigidity of the same in upward-and-downward direction and in rightward-and-leftward direction, thereby greatly damping vibration noise within a frequency range from 150 to 1500 Hz which vibration noise is predominant in automotive engine noise.

What is claimed is:

1. An internal combustion engine comprising:

a cylinder block having a plurality of cylinder barrels, and a plurality of bearing sections for journals of a crankshaft; and a bearing beam structure secured to a bottom part of said cylinder block and including a plurality of bearing cap sections each of which associates with each cylinder block bearing section to define a bore for rotatably receiving crankshaft journal, first and second upper beam sections disposed parallel with an axis of the crankshaft and located respectively along two upper portions, opposite to each other with respect to the axis of the crankshaft, of each bearing cap section to securely connect said bearing cap sections to each other, said first and second upper beam sections being located in a vicinity of said cylinder block bottom part, and first and second lower beam sections disposed parallel with the crankshaft axis and located respectively along two lower portions, opposite to each other with respect to the crankshaft axis, of each bearing cap section to securely connect said bearing cap sections to each other, said two lower portions being positioned apart from said first and second upper beam sections, each of said beam sections being separately spaced apart from one another in regions between adjacent bearing cap sections.

2. An internal combustion engine as claimed in claim 1, wherein said first and second upper beam sections and said first and second lower beam sections are located outside of an envelope of the outer-most loci of the crankshaft.

3. An internal combustion engine as claimed in claim 1, wherein said two upper portions are two upper corner portions of said bearing cap section which corners are opposite to each other with respect to the crankshaft axis and are in contact with the cylinder block bottom part; and said two lower portions are two lower corner portions of said bearing cap section which lower corner portions are opposite to each other with respect to the crankshaft axis and are positioned apart from said two upper corner portions, in which a distance between said two upper corners is larger than that between said two lower corner portions.

4. An internal combustion engine as claimed in claim 3, said first and second upper beam sections are positioned generally symmetrical with each other with respect to a vertical plane containing the crankshaft axis; and said first and second lower beam sections are positioned generally symmetrical with each other with respect to the vertical plane.

5. An internal combustion engine as claimed in claim 4, wherein said first and second upper beam sections being shaped as a rectangle in section; and said first and second lower beam sections being shaped as a right-angled triangle in which a surface of each lower beam section corresponding to a base of the triangle faces the crankshaft, and a ridge, corresponding to the right-angled corner of the triangle, faces an inner wall surface of an oil pan secured to said cylinder block bottom part.

6. An internal combustion engine as claimed in claim 4, wherein said first and second lower beam sections are so located that a line connecting a center axis of each lower beam section and the crankshaft axis intersects the vertical plane at an angle ranging from 20 to 70 degrees on a vertical plane to which the crankshaft axis is perpendicular.

* * * * *